United States Patent [19]

Urbano

[11] Patent Number: 4,481,887

[45] Date of Patent: Nov. 13, 1984

[54] SECURITY DOORS

[76] Inventor: Enrique Urbano, c/o Jose L. Castro 250 Catalonia, Coral Gables, Fla. 33134

[21] Appl. No.: 413,499

[22] Filed: Aug. 31, 1982

[51] Int. Cl.[3] ..... F05G 5/02

[52] U.S. Cl. ..... 109/3; 109/6; 49/30; 49/68

[58] Field of Search ..... 109/2-8, 109/12; 49/30, 68

[56] References Cited

U.S. PATENT DOCUMENTS 2,405,710 8/1946 Phillips ..... 109/5
3,669,038 6/1972 Watson ..... 49/68

FOREIGN PATENT DOCUMENTS 2409364 7/1979 France ..... 109/7
7308642 12/1974 Netherlands ..... 109/7

*Primary Examiner*—Gene Mancene
*Assistant Examiner*—Kris R. Schulze
*Attorney, Agent, or Firm*—Holman & Stern

[57] ABSTRACT

A security door and system for installation as the entrance and exit to a building or office to automatically control the passage of persons therethrough and to trap certain persons therein comprising a vestibule having side walls and oppositely disposed doors which open and close automatically under the control of photocell detectors and time delay relays. The photocells energize motors which open a respective door through which the person may enter the unit. After a predetermined time delay the opposite door opens. An emergency switch is provided to override the automatic control so that a person can be trapped and detained within the vestibule if desired or necessary.

6 Claims, 6 Drawing Figures

SECURITY DOORS

FIELD OF THE INVENTION

This invention relates to automatic doors to control the entrance and exit to a room or a building, such as a bank, store, vault, or similar establishment requiring some precautions against illegal access, theft, burglary or robbery, for example.

DESCRIPTION OF THE PRIOR ART

Protective door systems of the type which provides some degree of protection and security for banks and similar offices, have been designed utilizing doors which open and close automatically, bullet proof glass, weapons detectors and locking devices, such as shown in U.S. Pat. No. 4,060,039 issued Nov. 29, 1977 to Lagarrigue, U.S. Pat. No. 4,308,803 issued Jan. 5, 1982 to Pretini, and U.S. Pat. No. 3,413,934 issued Dec. 3, 1968 to DiGiacobbe. However, these previously designed door systems have not been accepted and utilized generally because they are too complex, expensive to manufacture, impractical to use, and difficult to install.

BRIEF SUMMARY OF THE INVENTION

The instant invention overcomes the above disadvantages by providing security doors and a security door system which substantially improves upon the prior art doors and systems by providing security doors which provide the desired control of access and egress, are simple and economical to manufacture, are easy to install in existing or new building structures and are practical and safe to use.

In the instant invention, single unit security doors are comprised essentially of a vestibule, or enclosure, enclosed by bullet proof walls, a floor and ceiling, and bullet proof doors controlling access and egress to the vestibule through entrance and exit doorways. The vestibule, or access way is constructed on site, or in modular form, of a framework of steel or heavy aluminum angles to form the framework and bullet proof glass, plastic, or other suitable bullet proof materials attached and enclosed within the frame. The frame may be constructed of any suitable material which is strong enough to support the panels which form the sides and ceilings and the mechanisms which support the movable doors.

In one embodiment of the invention, the vestibule is rectangular, or box like in shape, and each door opening at the ends thereof has installed therein double swinging doors mounted on their outer vertical edges for pivotal movement by hinges so that their inner edges in the closed position meet in abutting relationship substantially in the middle of the opening. The doors are operated automatically by photocells which detect a person in position to enter the vestibule and controlled drive motors which open the doors. A visual light control is provided above each doorway comprising essentially a green light to indicate that the vestibule is empty and is ready to be entered and a red light to indicate that the vestibule is occupied or otherwise not ready to be used. An automatic timing device is provided and operates after a person has entered the vestibule through the first set of doors a predetermined period of time to open the second set of doors to allow the person to leave the vestibule and enter the building, or vice versa. Overhead ventilators are provided in the ceiling to vent the atmosphere within the vestibule. The single access door system provides an access way through which persons both enter and leave a building or room, but double unit doors of substantially the same construction can be used side by side whereby one door system controls entrance and the other door system controls the exit from a building or room.

In a second embodiment of the invention, the vestibule may be in the form having a circular cross-section wherein the doors slidingly open and close in a circumferential path.

In the operation of the door system of this invention, a person desiring to enter approaches the doorway if the green light is on and when in the proper proximity the photoelectric cell detects him and operates the motors which open the doors whereupon the person may enter into the vestibule. The door on the opposite side of the vestibule however remains closed. After entering the vestibule, the doors through which the person has passed automatically close and upon closing energize the timing device which after a predetermined period, such as 2 to 7 seconds, actuates the motor drive means for the second pair of doors whereupon they are opened so that the party may exit therethrough, the first set of doors through which he entered remaining closed. During this passage of a person into and out of the vestibule, the red lights over the doorways are energized to indicate that no other persons may enter from either direction, and during the predetermined time period before the second door opens to allow exit, the photoelectric cells are deenergized, or bypassed, so that they will not operate to open either one of the doors. If the side walls and doors are made of transparent bulletproof glass, or plastic, the persons entering and leaving may be observed during their entire passage through the door system.

In the event someone did gain access to the building or room and were able to commit a robbery, burglary, or some other crime therein, and thereafter attempted to leave through the security door system, a guard or other person within the room or building who is aware of a crime could operate a switch, provided therefore conveniently as a floor or wall switch within easy access to a bank teller's window, for example, which is integrated into the electric control circuit for the doors so that it would energize an overriding door locking system whereby when the individual committing the crime is within the controlled access or vestibule, all doors are closed and locked to trap him therein. Alternatively, a plurality of hand-held remote control switches primarily under the control and operation of authorized personnel could be utilized so that upon becoming aware of a crime any person having such a remote control switch could operate it to remotely activate the overriding door locking circuit through a receiver integrated into the electric control circuit.

BRIEF DESCRIPTION OF THE DRAWINGS

Details of structure and other novel features of this invention and the manner of operation thereof will now be described with reference to the accompanying drawings wherein.

DETAILED DESCRIPTION

Figure 1:
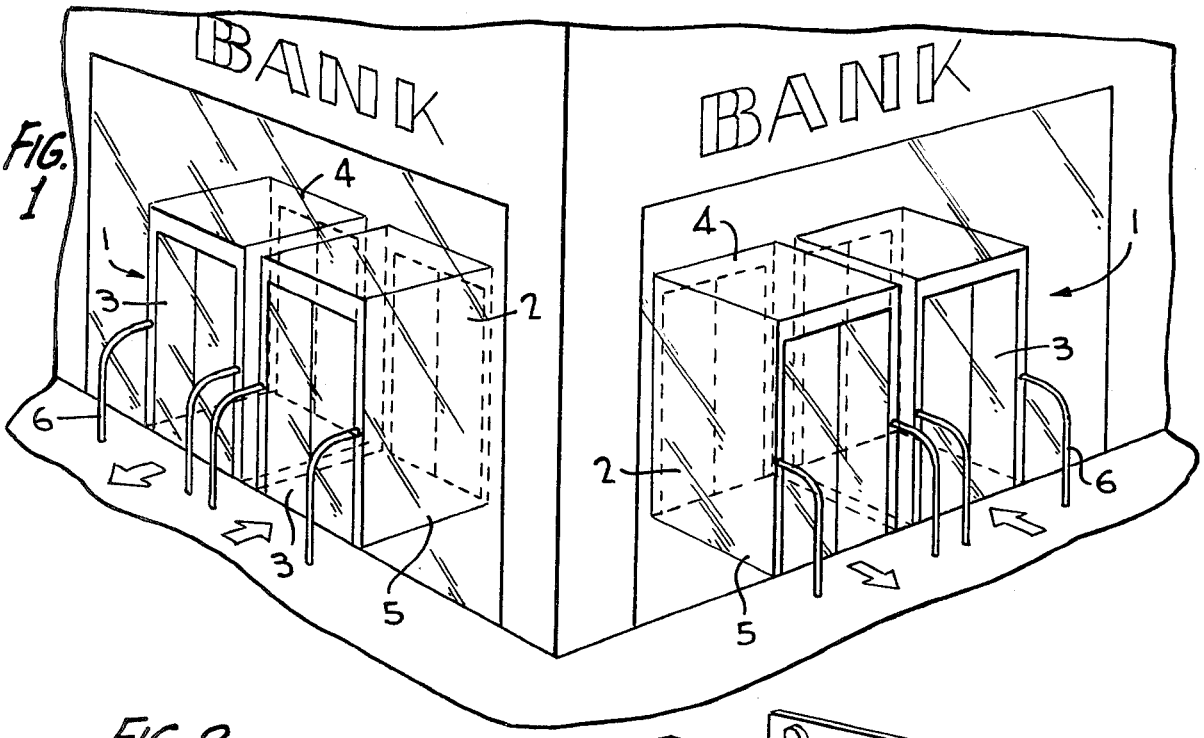
FIG. 1 is a schematic illustration of a manner in which the security doors of this invention may be installed and utilized as double unit doors.

FIG. 1 shows in schematic form the manner in which the security doors and security door system of the instant invention can be installed as entrance and exit portals at the street level of a building or office therein. In the illustration the embodiment wherein double units are used is shown, a single unit being used for entrance and another single unit being used for exit. Each single unit is indicated generally by the numeral 1 and has sides 2, inner and outer pairs of doors 3, a ceiling 4 and floor 5. Guide rails 6 are provided extending outwardly from the door frames and may serve as hand rails and stoppers for the doors when swung outwardly.

Figure 2:
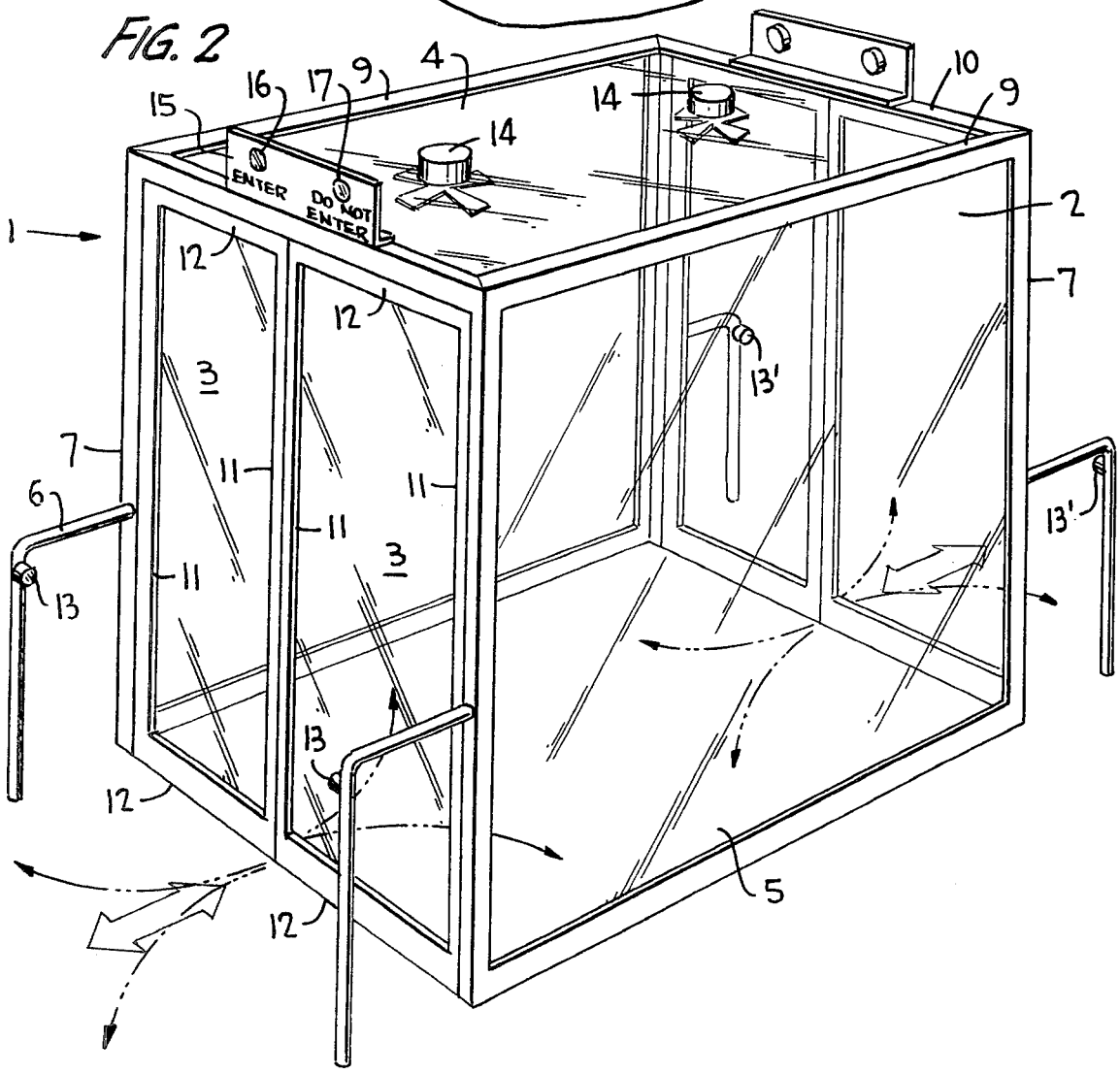
FIG. 2 is a perspective view of an embodiment of this invention having a rectangular or box-like configuration with transparent bullet proof walls and doors which may be utilized as a single unit doorway.

FIG. 2 shows the security door system of this invention in greater detail. A framework is constructed of suitable materials such as angle iron, steel angle material, wood, or heavy duty plastic, comprising vertical corner members 7 and upper horizontal side members 9 and upper door sill members 10. The lower ends of the vertical frame member 7 can be anchored to the floor 5 in any suitable manner, or if the entire vestibule is made in modular form, the floor 5 is attached as an integral part to the lower ends of the frame member 7 by means of lower horizontal side frame members and lower door sills (not shown). Each door assembly is constructed of dual doors which are connected at their outer vertical edges by suitable hinges (not shown) for swinging movement about a vertical axis at the outer edges. These doors meet in abutting relationship at the center of the opening in which they operate and are constructed with a framework of vertical frame members 11 and horizontal upper and lower frame members 12. Panels of bullet proof material are rigidly supported at their edges within the framework to form the side wall 2, top or ceiling 4, and door panels 3. If it is desired to provide for observation of persons passing through the vestibule, these panels are made of transparent bullet proof glass or plastic material. The side panels, doors, ceiling and floor can be made if desired as separate components which are fastened together on the site at their edges in any suitable manner such as welding, bolting, etc., to form the controlled passageway.

Electric eye or photocell units 13, 13' may be installed on the guard rail member 6 or in some other suitable location to detect persons in the entrance way of the door and to automatically open the doors as described in greater detail hereinafter.

Vents 14 are provided in the top of the vestibule such as in the top panel 4, to provide adequate ventilation within the vestibule while in service. Electric fans or some other suitable type of forced ventilation may be installed in these vents if necessary, or to provide air conditioning within the vestibule if desired.

Figure 4:
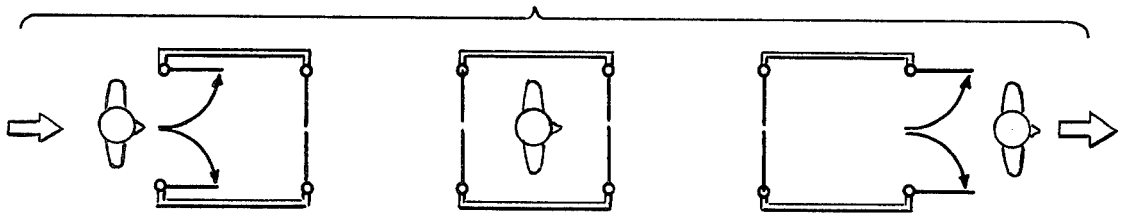
FIG. 4 is a schematic illustration of the sequence of operations of a single unit security door in accordance with the invention.

Control lights are provided mounted over the doorway as shown in FIG. 2, or in some other suitable location where they will be readily visible to the person entering the unit. In the embodiment illustrated, a panel 15 is provided mounted over the middle of the top door sill and has green light 16 and red light 17 mounted therein and electrically connected to an automatic control device so that the green light is on when the unit is not previously occupied or out of service, or interrupted for some reason which will be apparent from the further description below.

Where a single unit is used, such as shown in FIG. 2, a panel 15 with the indicator light therein will be mounted over each doorway to control traffic from both directions. The indicator lights will be interconnected in an electrical circuit (not shown) in a manner which will be readily apparent to one familiar with the art, so that the first to arrive at either entrance, under normal circumstances of operation, will be signalled by the green light to enter and anyone arriving thereafter will be signalled by the red light that he cannot enter, thereby avoiding simultaneous counter traffic or congestion through the unit. FIG. 4 shows a schematic illustration of the normal sequence of operation of a single unit security door in accordance with the invention. In this illustration, the person enters from the left and travels to the right. It can be seen that once the person moves into the area of view of the indicating control lights, if the green light is on, and he moves into the beam of the photocell 13, the photocell 13, as shown in the circuit diagram of FIG. 6, energizes a motor control unit 18 for the outer door motor 19 which opens the doors by swinging them inwardly to allow the person to enter the vestibule after which the doors close automatically. Upon closing, the outer door trips a normally open switch 20 which closes the circuit to a time delay relay 26 which after a predetermined delay of approximately 2 to 7 seconds, for example depending upon the desired delay time, energizes the motor control 21 which further energizes the inner door motor 22 to open the inner doors by swinging them outwardly. Where the travel through the vestibule is in the opposite direction, the sequence of operation is the same but in reverse order, i.e. photocell 13' energizes motor control unit 21 which energizes inner door motor 22 to open the inner doors inwardly. Upon closing, the inner doors trip switch 20' which energizes time delay relay 26', which after the pre-set time delay energizes motor control unit 18 to operate motor 19 to open the outer doors outwardly. Therefore, it can be seen that the doors swing inwardly or outwardly with respect to the vestibule depending on whether a person is entering or leaving it, the motor control units 18 and 21 being designed to operate the outer and inner doors to swing either inwardly or outwardly respectively. The red and green traffic control lights are of course integrated into the circuit of FIG. 5 in a manner (not shown) within the skill of a person familiar with the art so that they are coordinated with the other operating features in the normal sequence. A different circuit than that shown in FIG. 6 could also be designed to carry out the above sequence of operation in order to utilize the invention.

Figure 5:
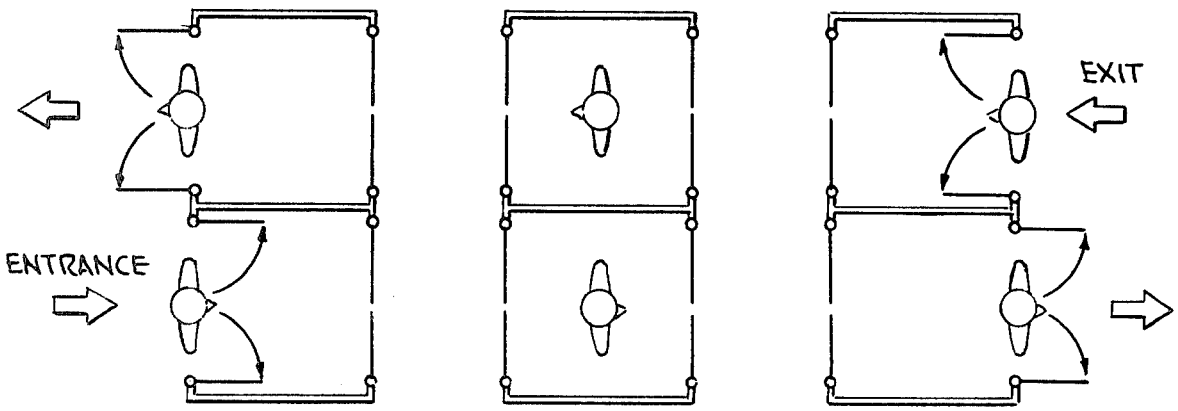
FIG. 5 is a schematic illustration of the sequence of operations of a double unit security door system in accordance with the invention.

The security doors of this invention may also be used as double units where they are positioned side by side, as shown in FIG. 1 and in the double unit sequence of operation shown in FIG. 5. In this embodiment, the operating sequence is the same as shown for a single unit, and as in FIG. 6, except that in normal operation there is always one way traffic through each unit, one being used for entrance and the other being used for exit. This embodiment obviously avoids any possibility of traffic congestion due to two way traffic through a single unit.

In the event a person has gained access to the interior of a building or office establishment and committed a theft, burglary, robbery, or some other crime, and is detected before escape, the switch 23, which may be located for example accessible to a bank teller, can be manually operated to actuate normally closed relay 24 which breaks the circuit to the outer door power control thereby preventing it from being opened, but allows the inner door photocell 13' to continue to function so that the person attempting an escape is allowed to enter the vestibule after which the inner doors close and thereby trap the escapee within the vestibule since the outer door cannot be opened due the breaking of the circuit by relay 24. This is the emergency operation for manual control of a single unit safety door, but the operation of a double unit safety door is substantially the same because the inner door of the entrance unit of a double unit will not open in any case to allow exit therethrough and therefore the person attempting an escape must leave through the exit unit. The switch 23 remains closed either manually or automatically (not shown) during the emergency phase of operation.

Figure 6:
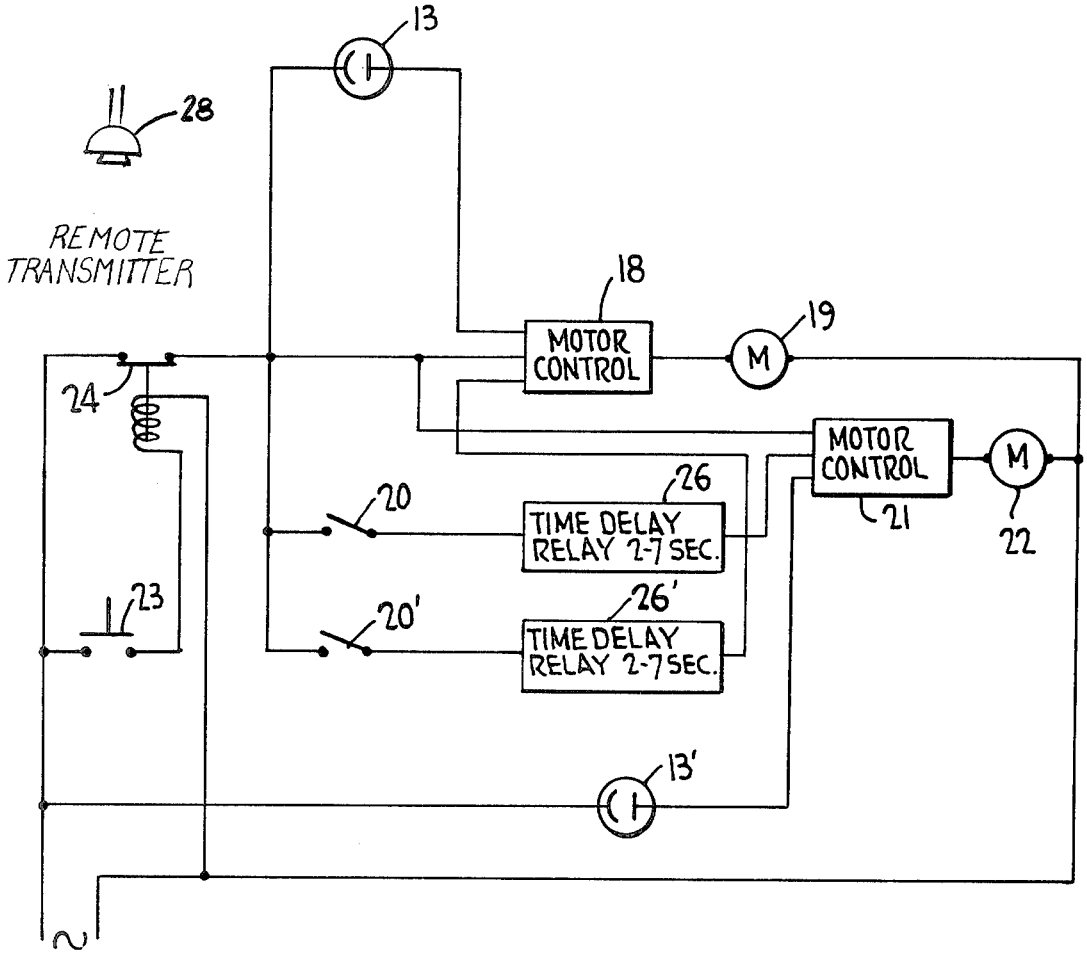
FIG. 6 is a schematic electrical circuit diagram showing the manner in which the various components used to operated the security door system of this invention may be electrically connected to operate the system.

The relay 24 can also be adapted to be operated remotely by a hand-held remote control unit, such as a radio or ultrasonic signal emitter (28), for example, which signals a receiver (30) integrated into the control circuit of FIG. 6 in a manner to operate relay 24, or other suitable emergency device to override the normal control means. Such a hand-held remote control unit, or a number of them, would be issued to authorized personnel within the building or secured area, to be operated only upon such a person becoming aware of a crime being committed.

When the switch 23, or a remote control switch, is operated to activate the door locking system, all access to the controlled area thereafter is locked or prevented and only the inner door to the vestibule will operate once thereby permitting the person trying to leave the controlled area to enter the vestibule. Thereafter, both inner and outer doors are locked and cannot be opened by anyone inside the secured area or building. In order to thereafter gain access to the locked vestibule for the purpose of removing the person trapped therein, or normalizing operation of the security door system, an authorized person in control of an overriding switch or control means (not shown) outside the secured area or building, is alerted and at the proper time may activate a device to operate the outer door only, or normalize the operation of the door system. Such an authorized person can be a security guard within the building but outside the secured area, or outside the building. Such an authorized person could also be a remote private security organization, and/or police department. The switch that opens the outer door, or normalizes the operation, could be a remote control device, such as an ultra-sonic or radio-signal generator, e.g., which signals a receiver (30) integrated into the electrical control circuit, and/or in the motor control units 18, 21, or relay 24.

It is pivotal to this invention that after once being secured or locked by the emergency control to trap a person, the security doors can only be opened by authorized personnel outside the secured area, as above described, thereby preventing a criminal from forcing someone inside the secured area to open the doors.

The operating circuit shown in FIG. 6 is a generally schematic representation of a circuit which could be used in this invention, but other circuits may be designed which would perform equally as well and may include other features such as weapons detectors for example which would be electrically integrated into the circuit to lock the doors in the closed positions by overriding the time delay relay and thereby trapping the person carrying the detected weapon within the vestibule. Such an undesirable person who is detected by observation through the transparent bullet proof glass panels or doors by a person inside the office or building, can also be trapped within the vestibule by operating the switch 23 which breaks the circuit to the time delay relay thus preventing the opening of the inner door.

Figure 3:
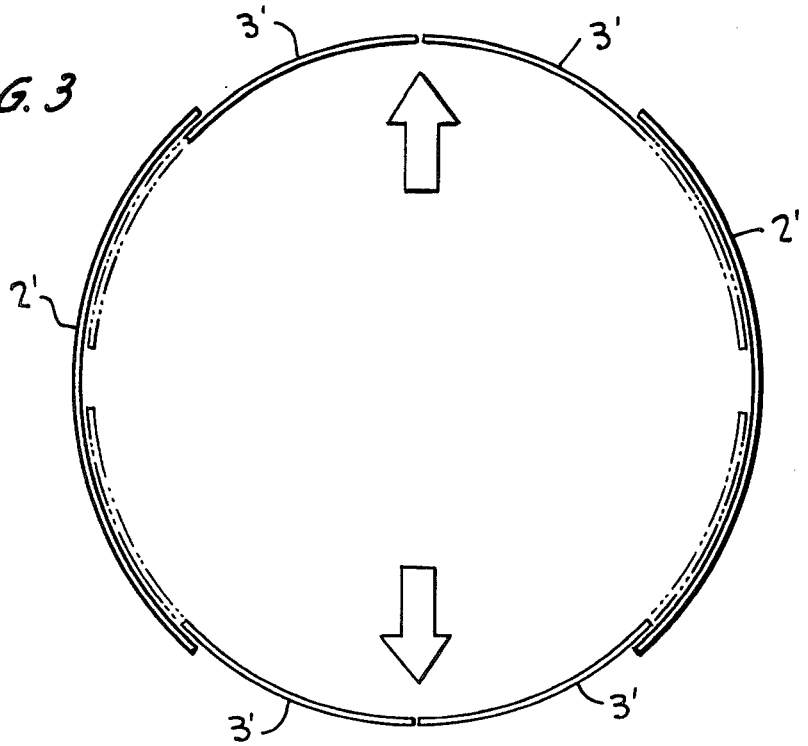
FIG. 3 is a schematic plan view of another embodiment of this invention having a generally circular configuration.

In the above embodiments the invention has been described in the configuration of a rectangular vestibule. However, these security door units may have the configuration of circular units as shown in FIG. 3. In the circular configuration embodiment, the side panels 2' and doors 3' when closed prescribe a substantially circular cross-section. Instead of swinging to open or close, the doors 3' move slidingly in tracks or similar mounting structure so that they open by being moved in a substantially circumferential path into concealed positions adjacent the inside surface of the side panels 2', as shown in dotted lines in FIG. 3 However, the electrical circuitry and sequence of operation previously described in connection with the rectangular configuration is the same.

The particular type of photocell, motor control units, outer and inner door motors, time delay relay, outer and inner door return switches, manual switch and other relays are not described in detail since these may be commercially available components which can be utilized in the operable combination described above so that they function in a manner to facilitate the sequence of operations in accordance with the invention. Similarly, the particular design of the mechanism for opening and closing the doors driven by the door motor, or motors, is not shown in detail since it is not a part of this invention, and would be within the skill of a person familiar with the art to produce in order to make and use this invention.

I claim:

1. A security door system for a building, office, or the like of the type wherein a vestibule is provided as the passageway through which people must enter and leave comprising, an outer door, an inner door, an enclosed passageway between said outer and inner doors comprised of a floor, ceiling and side walls, said doors, side walls, ceiling and floor being formed of panels of bullet-proof material joined together at their edges, door operating means to open and close said doors, entrance detector means for each door to detect the presence of a person in position to enter said passageway and operably connected to said door operating means to cause said door operating means to open the door at which said person is detected and to close said door when said person is inside said passageway, door closing detector means to detect the closed position of said door, time delay means operably connected to said door closing detector means to be energized thereby and operably connected to said door operating means for the other door so that after a pre-set time delay the door operating means for said other door opens said other door to allow said person to exit therethrough, locking control means operably connected to said door operating means to selectively prevent said door operating means from opening any of said doors after said person is inside said passageway to thereby imprison said person within said passageway, said vestibule being constructed of a hollow framework formed of vertical and horizontal frame members and door frames for said doors, said panels being attached at their edges to said frame members, said inner and outer doors each comprising a set of double doors connected by hinges at their vertical outer edges to said door frames for swinging movement, the inner edges of each set of doors meeting in abutting relationship when closed at substantially the center of the doorway, said panels being transparent and attached to said framework, and further comprising venting means to ventilate said passageway, and green and red indicating lights provided adjacent each doorway operably connected to said door operating means to provide visual signals to control traffic through said passageway.

2. The security door system as claimed in claim 1 wherein said door operating means comprises a separate motor control means and electric motor drive means for each set of doors, each motor control means controlling the respective motor drive means to open the respective doors through which a person is passing inwardly for entrance into said passageway and outwardly for exit from said passageway.

3. The security door system as claimed in claim 2 wherein said motor control means, electric motor drive means, entrance detection means, door closing detection means, time delay means and locking control means are interconnected in an electrical circuit, and further comprising an electrical power supply connected to said circuit, said locking control means comprising means to break said power supply circuit to said entrance detection means, motor control means for said outer doors, time delay means and door closing detector means.

4. The security door system as claimed in claim 3 wherein said means to break said power supply circuit comprises a normally closed relay in said power supply circuit and switch means to operate said relay.

5. The security door system as claimed in claim 4 wherein said switch means comprises a manually operated normally open switch operably connected in the power circuit to said relay.

6. The security door system as claimed in claim 3 wherein said locking control means comprises a remotely activated receiver means connected to an overriding means operably connected in said circuit to override the operation of the components thereof so that after the inner door is opened and closed, the doors are locked and can thereafter be opened only by a remotely operated means deenergizing said overriding means, remote switch means to emit a signal to actuate said receiver means and thereby said overriding means, and remotely operated deenergizing means to deenergize said overriding means.

* * * * *